US006059563A

United States Patent [19]

Hsu

[11] Patent Number: 6,059,563

[45] Date of Patent: May 9, 2000

[54] GAS LIGHTER WITH DUAL SAFETY MECHANISM

[76] Inventor: Huang-Hsi Hsu, 8F, No. 14, Lane 252, Chungshan N. Rd., Sec. 6, Taipei, Taiwan

[21] Appl. No.: 09/414,972

[22] Filed: Oct. 12, 1999

[30] Foreign Application Priority Data

Jun. 25, 1999 [TW] Taiwan ..... 88210566

[51] Int. Cl.[7] ..... F23D 11/36

[52] U.S. Cl. ..... 431/153; 431/255

[58] Field of Search ..... 431/153, 255

[56] References Cited

U.S. PATENT DOCUMENTS 5,967,768 10/1999 Saito et al. ..... 431/153

5,980,242 11/1999 Man ..... 431/153

*Primary Examiner*—Carroll Dority

*Attorney, Agent, or Firm*—Bacon & Thomas

[57] ABSTRACT

A gas lighter with dual safety mechanism comprises an actuator mechanism provided between an ignition button and a gas fuel reservoir having a push means protruded from a surface of gas lighter, a first elastic member urged against actuator mechanism, a slidably mounted connecting rod on actuator mechanism, and a second elastic member put on a side of connecting rod. In operation, continuously press push means until connecting rod is aligned with ignition button and gas fuel reservoir. Then press ignition button to urge against connecting rod for pivotably rotating a pivotal member to activate a piston of gas fuel reservoir to open an outlet to discharge gas fuel which in turn flows to a tube member for igniting the gas lighter. An ignition is only made possible through activation of actuator mechanism and ignition button and thus, a mechanism for preventing inadvertent ignition of the gas lighter is obtained.

8 Claims, 6 Drawing Sheets

GAS LIGHTER WITH DUAL SAFETY MECHANISM

FIELD OF THE INVENTION

The present invention relates to a gas lighter, and more particularly to a gas lighter with dual safety mechanism to prevent inadvertent ignition of the gas lighter.

BACKGROUND OF THE INVENTION

A commercially available gas lighter shown in FIG. 1 comprises a housing 1, a gas fuel reservoir 2 provided in a suitable position within housing 1, and a high voltage coil 3 wherein an outlet 21 is provided on the top of gas fuel reservoir 2, a predetermined length of hose 22 is extended from outlet 21 to the top of housing 1, a short tube member 23 is provided on the top of housing 1 for enclosing outlet 21 and in fluid communication therewith, an adjustment level 24 is abutted on outlet 21 for regulating the flow of gas having a portion protruded from housing 1, and a pivotal member 25 is fixedly provided on a suitable position on the top of gas fuel reservoir 2 having one end disposed correspondingly to an actuator button 12 and the other end blocking the opening of outlet 21 in an inoperative position.

Further, actuator button 12 is located on an opening 11 of housing 1 having a portion protruded from housing 1. Actuator button 12 is pivotably mounted on an axis (not shown) on an end having a side within housing 1 fixedly secured to an elastic member 13 which further fixedly secures to a cavity 14. A conductive pad 15 is also provided on a side within housing 1 and adjacent to elastic member 13. A relay 20 is disposed correspondingly to pad 15.

When actuator button 12 is pressed down, an electrical power is transmitted from a high voltage coil 3 actuated by a power source (not shown) to relay 20 which in turn is enabled to be in electrical contact with pad 15 for making sparks in tube member 23 through a connection (not shown). Actuator button 12 urges against a side of pivotal member 25 for opening outlet 21 of gas fuel reservoir 2 to discharge gas fuel which in turn flows to tube member 23 through hose 22 for igniting lighter.

In brief, ignition of the gas lighter is simply by means of pressing actuator button 12. Accordingly, there is no mechanism provided in this gas lighter for preventing inadvertent ignition by a child. In view of this, this gas lighter is not a safe device.

SUMMARY OF THE INVENTION

It is thus an object of the present invention to provide a gas lighter with dual safety mechanism comprising an actuator mechanism is provided between an ignition button and a gas fuel reservoir having a push means protruded from a surface of gas lighter, a first elastic member urged against actuator mechanism, a slidably mounted connecting rod on actuator mechanism, and a second elastic member put on a side of connecting rod. In operation, continuously press push means until connecting rod is aligned with ignition button and gas fuel reservoir. Then press ignition button to urge against an end of connecting rod for pivotably rotating a pivotal member to activate a piston of gas fuel reservoir to open an outlet to discharge gas fuel which in turn flows to an ignition tube member for igniting the sparked lighter. With a gas lighter so constructed, an ignition is only made possible through activation of both actuator mechanism and ignition button and thus, a foolproof mechanism for preventing inadvertent ignition of the gas lighter by a child is obtained.

It is another object of the present invention to provide a gas lighter with dual safety mechanism in which sparks is made on ignition tube member by simply pressing ignition button.

The above and other objects, features and advantages of the present invention will become apparent from the following detailed description taken with the accompanying drawings.

DETAILED DESCRIPTION OF THE PREFERRED EMBODIMENTS

Figure 1:
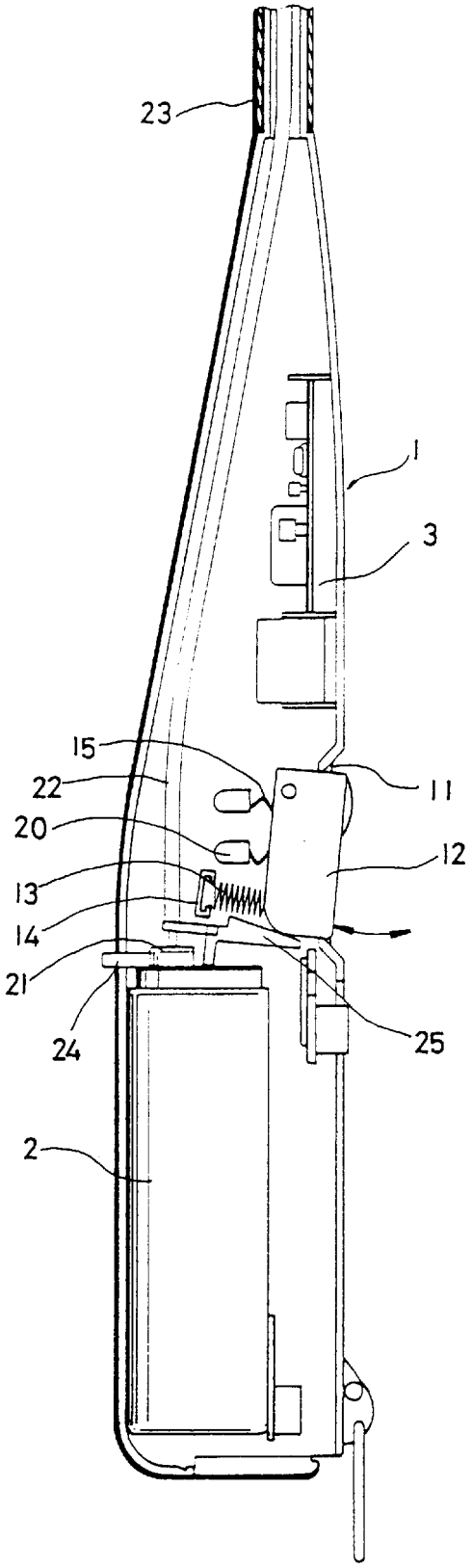
FiG 1 PRIOR ART
FIG. 1 is a sectional view of a prior art gas lighter.
Figure 2:
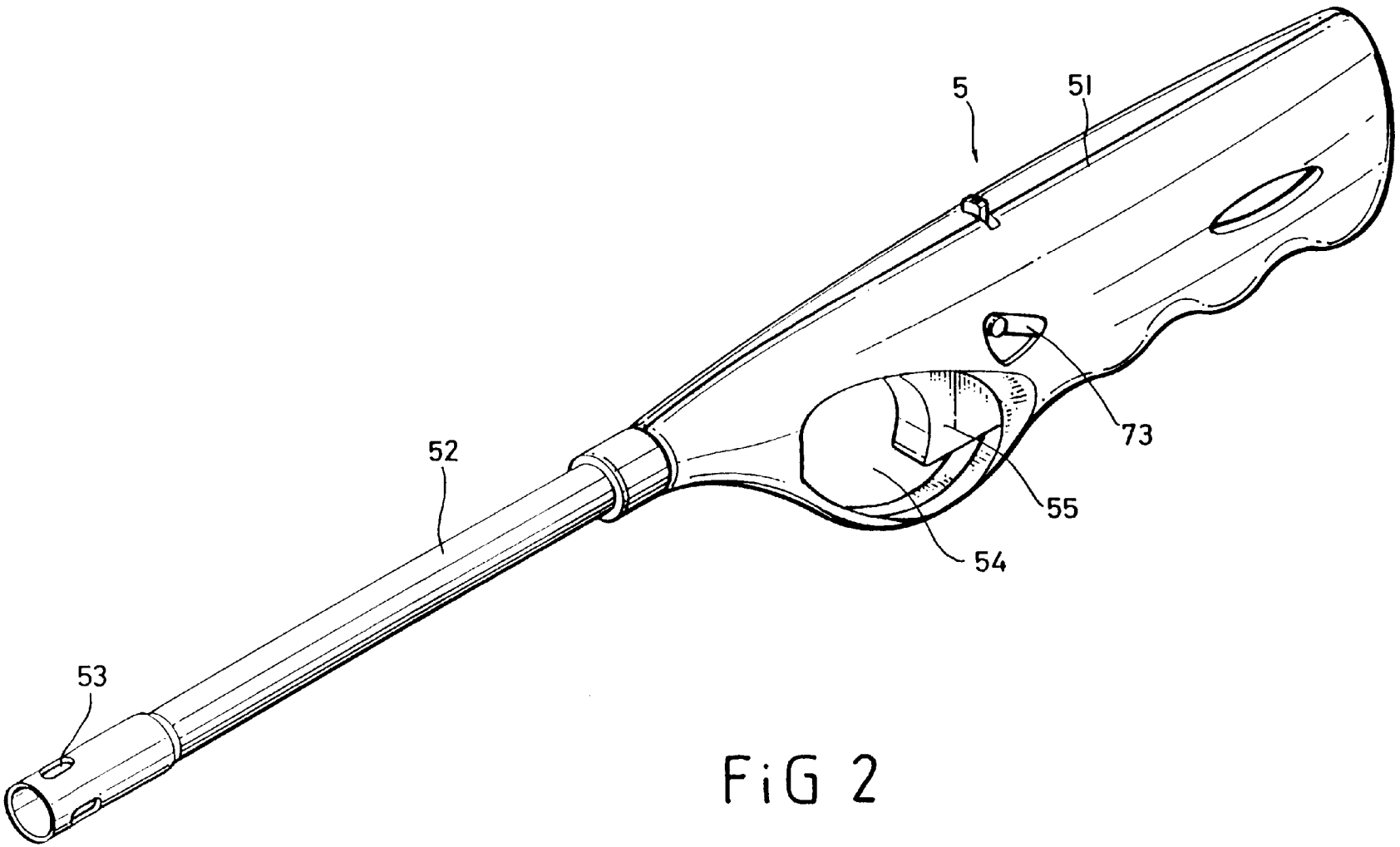
FIG. 2 is a perspective view of a gas lighter constructed according to the present invention.

Referring to FIG. 2, there is shown a gas lighter 5 comprising a handle grip 51 having a generally rectangular shape in a side view, an ignition tube member 52 extended a predetermined distance from the tapered head of handle grip 51, a number of holes circumferentially provided on distal end of tube member 52 for communicating air between inside and outside of tube member 52, an opening 54 provided on lower front portion of handle grip 51, and an ignition button 55 having one portion protruded from handle grip 51 and located in opening 54 for allowing one or more fingers to press thereon, and the other portion received within the handle grip 51.

Figure 3:
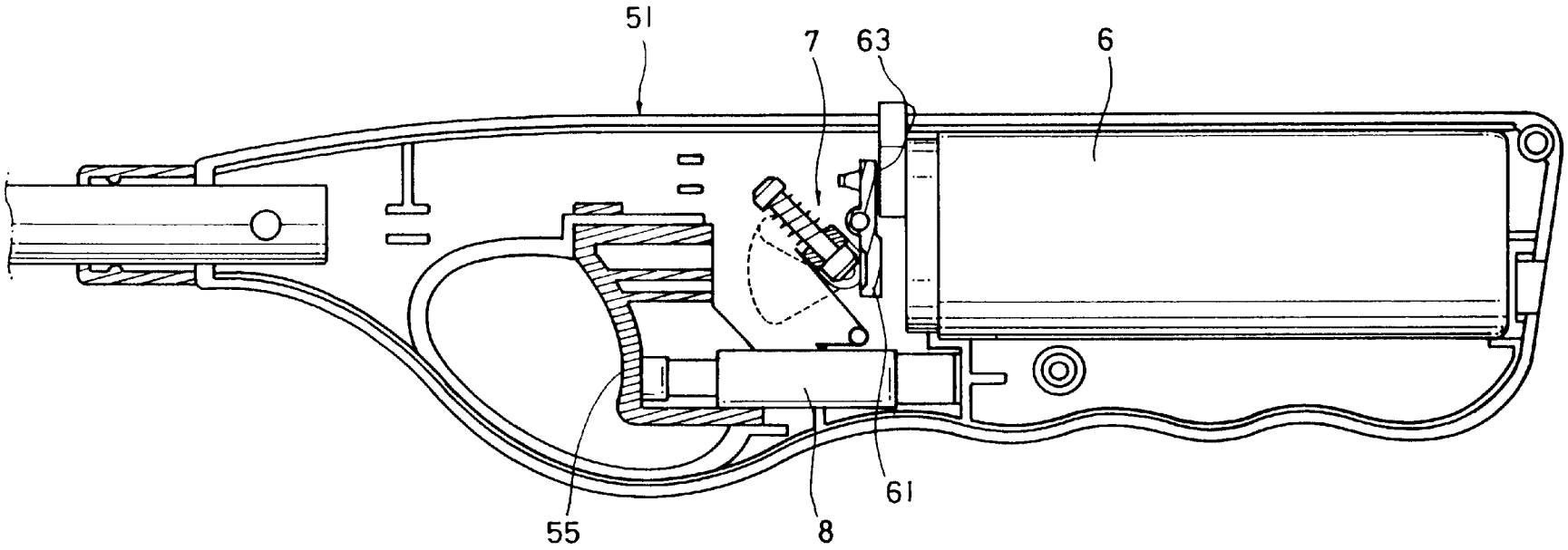
FIG. 3 is a partial sectional view of FIG. 2.

In FIG. 3, components within handle grip 51 are illustrated in which a gas fuel reservoir 6 is provided on upper rear portion of handle grip 51, an actuator mechanism 7 situated between ignition button 55 and gas fuel reservoir 6, and a lighter device 8 is provided adjacent to ignition button 55. As such, sparks will be made on the distal end of tube member 52 after lighter device 8 is activated by simply pressing ignition button 55.

Figure 4:
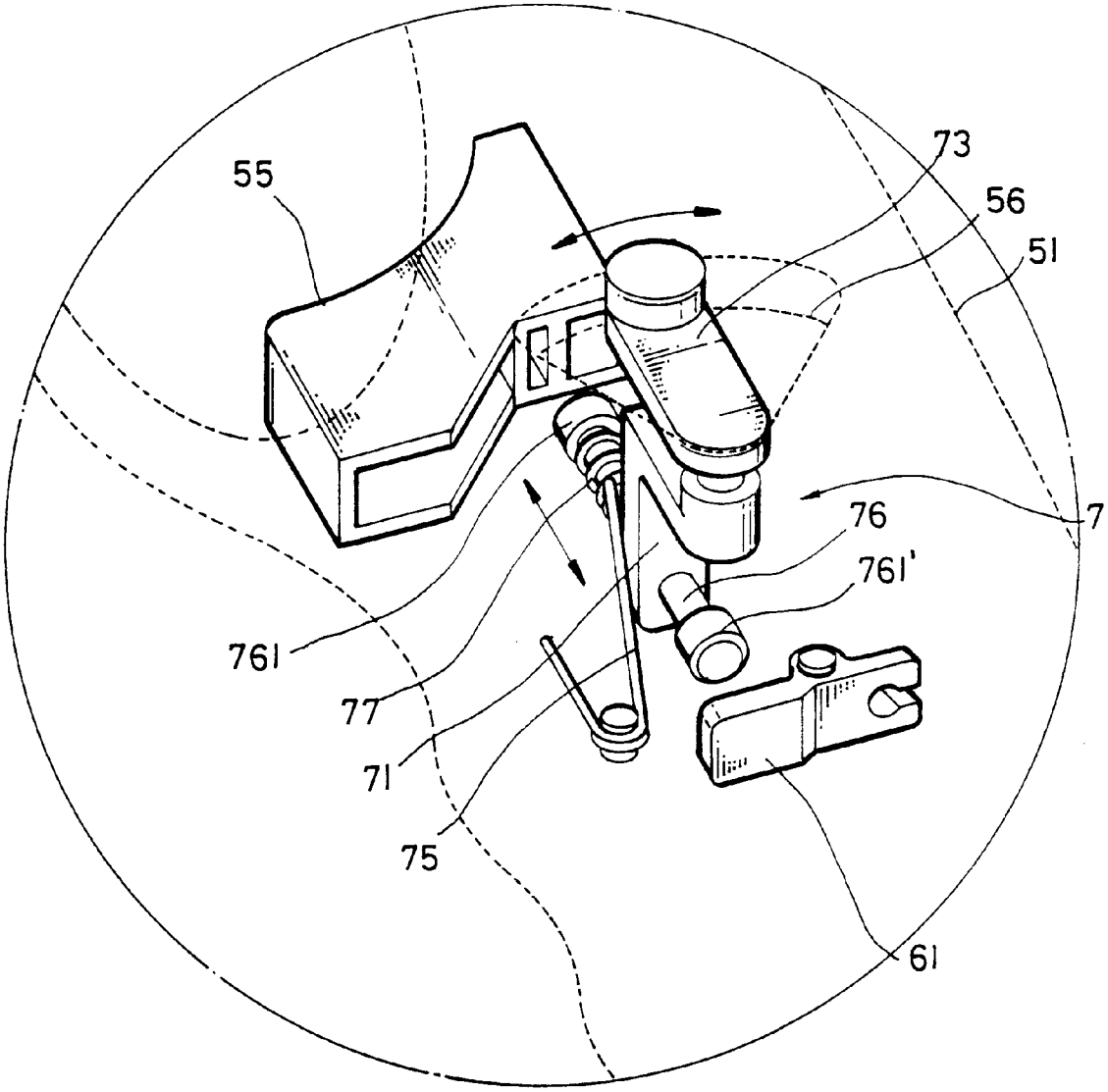
FIG. 4 is a partial perspective view of a first embodiment of actuator mechanism and adjacent components of gas lighter of FIG. 2.

In a first embodiment shown in FIG. 4, actuator mechanism 7 has a body 71 having an internal side pivotably mounted on handle grip 51, and a lever 73 provided on an external side of body 71 having a round portion on one free end projected from surface of handle grip 51 for facilitating slidingly moved by hand. The other end of lever 73 is pivotably retained in body 71. A sector-shaped opening 56 is provided on surface of handle grip 51 for defining a sliding range of lever 73. An elastic expansion element 75 is abutted against body 71. Note that elastic expansion element 75 is a spring in this embodiment, while other types of elastic element may be used in other embodiments which still falls within the scope of the invention. One end of elastic expansion element 75 is pivotably secured to handle grip 51 so as to have a biasing force when biased by body 51. Further, a connecting rod 76 is penetrated through and slidable within body 71. A pair of heads 761 and 761' each having a diameter larger than that of connecting rod 76 is provided on either end of connecting rod 76. An elastic member 77 is put on left portion of connecting rod 76, i.e., between head 761 and body 71. Note that elastic member 77 is a spring in this embodiment, while other types of elastic element may be used in other embodiments which still falls within the scope of the invention.

Figure 5:
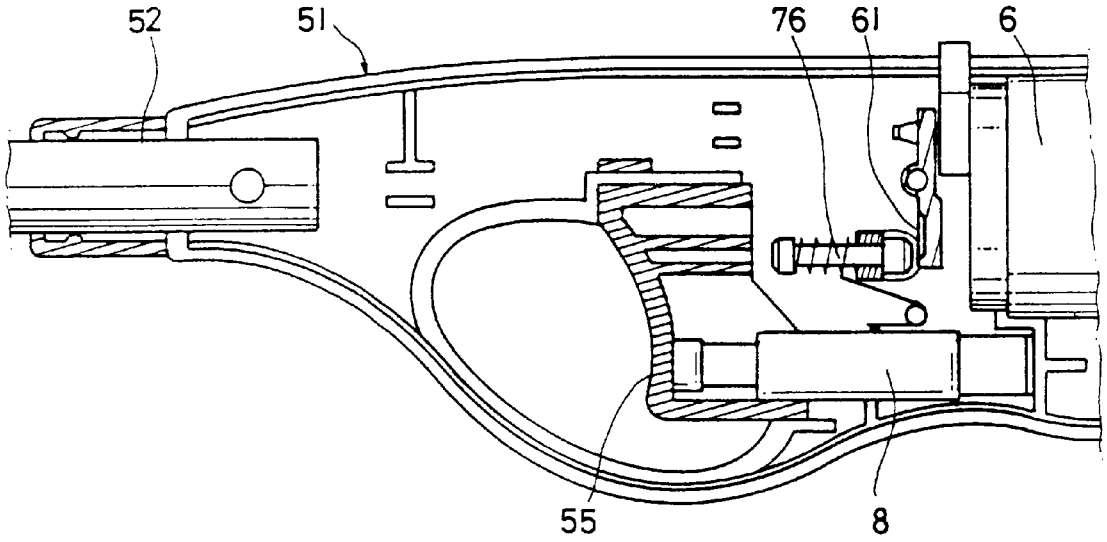
FIG. 5 is a partial sectional view of FIG. 2 showing gas lighter is in an inoperative position.

Referring to FIG. 5, sparks will be made on the distal end of tube 52 after lighter device 8 is activated by simply pressing ignition button 55. However, sparks will immediately extinguish after ignition button 55 is released. This is the case when lever 73 is not moved to a critical position by hand.

Figure 6:
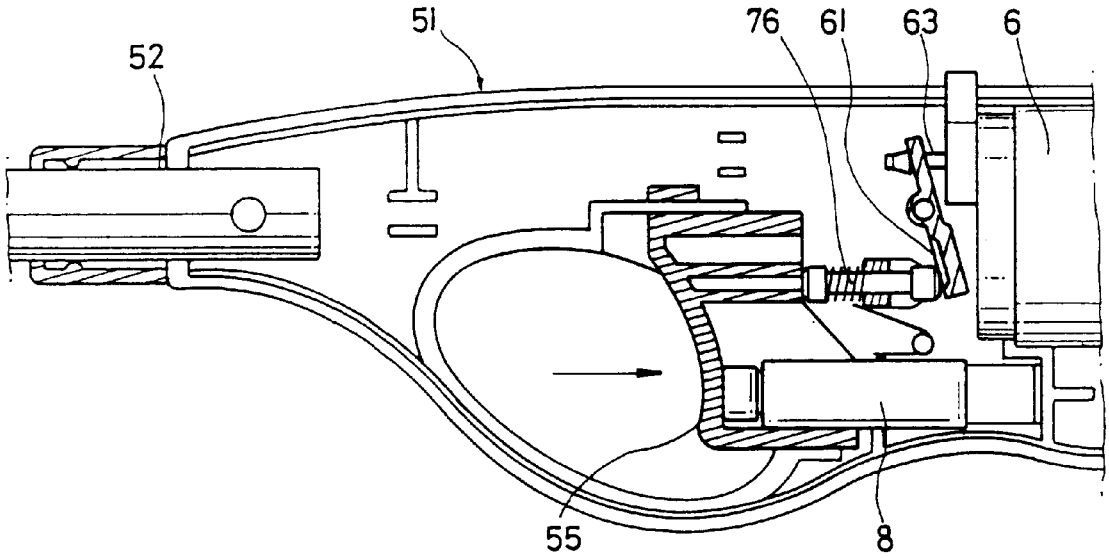
FIG. 6 is a partial sectional view of FIG. 2 showing gas lighter is in an operative position.

Referring to FIG. 6, actuator mechanism 7 is moved to a position generally aligned with ignition button 55 and gas fuel reservoir 6 by continuously pressing lever 73. Then press ignition button 55 to urge against head 761 of connecting rod 76 to cause head 761' to pivotably rotate pivotal member 61 of gas fuel reservoir 6, thereby opening a piston (not shown) of outlet 63 of gas fuel reservoir 6 to discharge gas fuel. As a result, gas flows to ignition tube member 52 for igniting the sparked lighter. This dual safety mechanism greatly reduces the possibility of inadvertent ignition of the gas lighter by young children.

Figure 7:
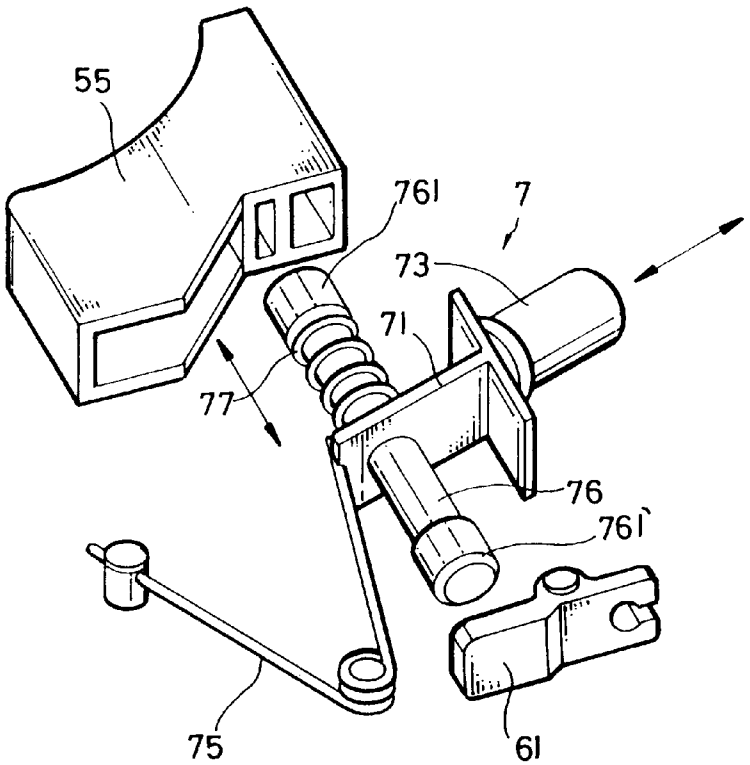
FIG. 7 is a second embodiment of actuator mechanism.

In a second embodiment shown in FIG. 7, actuator mechanism 7 has a body 71 pivotably mounted on handle grip 51, and a push button 73 provided on a side of body 71 having a portion projected from surface of handle grip 51 for facilitating pressed down by hand, thereby causing a limited movement of body 71. An elastic expansion element 75 is abutted against body 71. Note that elastic expansion element 75 is a spring in this embodiment, while other types of elastic element may be used in other embodiments which still falls within the scope of the invention. One end of elastic expansion element 75 is pivotably secured to handle grip 51 so as to have a biasing force when biased by body 51. Further, a connecting rod 76 is penetrated through and slidable in body 71. A pair of head 761 and 761' each having a diameter larger than that of connecting rod 76 is provided on either end of connecting rod 76. An elastic member 77 is put on left portion of connecting rod 76, i.e., between head 761 and body 71. Note that elastic member 77 is a spring in this embodiment, while other types of elastic element may be used in other embodiments which still falls within the scope of the invention. Similarly, body 71 is moved to a position generally aligned with ignition button 55 and pivotal member 61 of gas fuel reservoir 6 by continuously pressing push button 73. Then press ignition button 55 to ignite the gas lighter.

Figure 8:
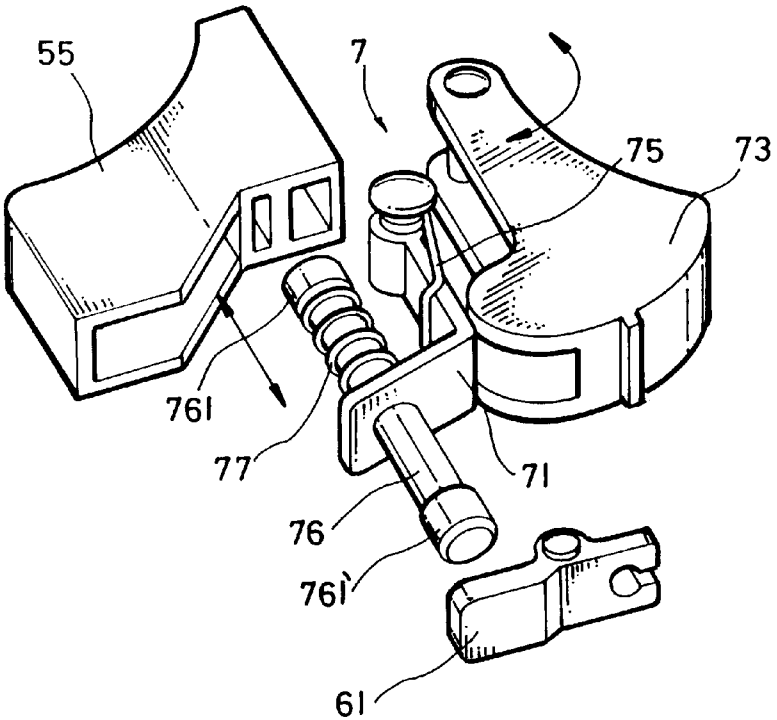
FIG. 8 is a third embodiment of actuator mechanism.

In a third embodiment shown in FIG. 8, actuator mechanism 7 has a body 71 pivotably mounted on handle grip 51, and a push button 73 provided on a side of body 71 having a portion projected from surface of handle grip 51 for facilitating pressed down by hand, thereby causing a limited movement of body 71. An elastic expansion element 75 has one end pivotably secured to the position of body 71 pivotably mounted on handle grip 51, and the other end abutted against body 71. Note that elastic expansion element 75 is a spring in this embodiment, while other types of elastic element may be used in other embodiments which still falls within the scope of the invention. As such, elastic expansion element 75 has a biasing force when biased by body 51. Further, a connecting rod 76 is penetrated through and slidable in body 71. A pair of head 761 and 761' each having a diameter larger than that of connecting rod 76 is provided on either end of connecting rod 76. An elastic member 77 is put on left portion of connecting rod 76, i.e., between head 761 and body 71. Note that elastic member 77 is a spring in this embodiment, while other types of elastic element may be used in other embodiments which still falls within the scope of the invention. Similarly, body 71 is moved to a position generally aligned with ignition button 55 and pivotal member 61 of gas fuel reservoir 6 by continuously pressing push button 73. Then press ignition button 55 to ignite the gas lighter.

While the invention herein disclosed has been described by means of specific embodiments, numerous modifications and variations could be made thereto by those skilled in the art without departing from the scope of the invention set forth in the claims.

What is claimed is:

1. A gas lighter comprising:

a handle grip having a tube member extended a predetermined distance therefrom;

an ignition button having one portion protruded from handle grip, and the other portion received within the handle grip;

a reservoir containing a gas fuel within the handle grip disposed correspondingly to and adjacent to the ignition button including an outlet having a piston, and a pivotal member extended from the outlet between the reservoir and the ignition button;

a lighter device provided adjacent to the ignition button capable of being activated by pressing the ignition button for making a spark on a distal end of the tube member; and an actuator means situated between the ignition button and the reservoir having a push means projected from a surface of the handle grip, an elastic expansion element capable of being biased by the push means through the actuator means, and a connecting rod penetrated through and slidable in the actuator means;

wherein the actuator means is moved to a position aligned with the ignition button and the reservoir by continuously pressing the push means, and the ignition button is pressed to urge against the connecting rod to pivotably rotate the pivotal member, thereby opening the piston of the outlet to discharge the gas fuel which flows to the tube member for igniting the gas lighter.

2. The gas lighter of claim 1, further comprising a plurality of holes circumferentially provided on a distal end of the tube member for communicating air between inside and outside of the tube member.

3. The gas lighter of claim 1, wherein the handle grip has an opening for receiving the protruded portion of the ignition button and allowing one or more fingers to press thereon.

4. The gas lighter of claim 1, wherein the connecting rod includes a first end, a center portion, and a second end, the first and second ends have a diameter larger than that of the center portion of the connecting rod.

5. The gas lighter of claim 1, further comprising an elastic member put on the center portion of the connecting rod and slidably secured between the first end of the connecting rod and the actuator means, the elastic member capable of being biased by the actuator means when the connecting rod is pressed.

6. The gas lighter of claim 1, 2, or 3, wherein the actuator means includes a body pivotably mounted in the handle grip on a first side of the body, and a lever provided on a second side of the body having a portion projected from a surface of the handle grip, and an elastic expansion element having one end pivotably secured to the handle grip and the other end abutted against the body whereby the body is capable of moving to a position aligned with the ignition button and the reservoir by continuously pressing the lever.

7. The gas lighter of claim 1, 2, or 3, wherein the actuator means includes a body, and a push button provided on a side of the body having a portion projected from a surface of the handle grip, and an elastic expansion element having one end pivotably secured to the handle grip and the other end abutted against the body whereby the body is capable of moving to a position aligned with the ignition button and the reservoir by continuously pressing the push button.

8. The gas lighter of claim 1, 2, or 3, wherein the actuator means includes a body pivotably mounted in the handle grip, and a pivotal push button abutted the body having a portion projected from a surface of the handle grip, and an elastic expansion element having one end pivotably secured to the handle grip and the other end abutted against the body whereby the body is capable of moving to a position aligned with the ignition button and the reservoir by continuously pressing the lever.

* * * * *